United States Patent [19]

Farque

[11] Patent Number: 4,876,539

[45] **Date of Patent: * Oct. 24, 1989**

[54] PARAMETER TELEMETERING FROM THE BOTTOM OF A DEEP BOREHOLE

[75] Inventor: Claude A. Farque, Tulsa, Okla.

[73] Assignee: Oil Dynamics, Inc., Tulsa, Okla.

[ * ] Notice: The portion of the term of this patent subsequent to Oct. 28, 2003 has been disclaimed.

[21] Appl. No.: 216,279

[22] Filed: Oct. 14, 1988

Related U.S. Application Data

[63] Continuation of Ser. No. 866,896, May 27, 1986, Pat. No. 4,788,545, which is a continuation-in-part of Ser. No. 523,455, Aug. 15, 1983, Pat. No. 4,620,189.

[51] Int. Cl.[4] ..... G01V 1/00; E21B 29/02

[52] U.S. Cl. ..... 340/856; 340/858

[58] Field of Search ..... 340/853, 856, 857, 858, 340/859; 367/81, 82; 175/40, 48; 166/66, 65.1, 66.4; 455/40, 45, 59, 67

[56] References Cited

U.S. PATENT DOCUMENTS

| | | | |
|---|---|---|---|
| 2,225,668 | 12/1940 | Subkow et al. | 177/352 |
| 2,372,582 | 3/1945 | Kean | 73/151 |
| 2,379,996 | 7/1945 | Silverman | 177/351 |
| 2,573,133 | 10/1951 | Greer | 340/859 |
| 2,886,750 | 5/1959 | Vogel | 340/870.26 X |
| 3,284,669 | 11/1966 | Boyd | 317/13 |
| 3,340,500 | 9/1967 | Boyd et al. | 340/18 |
| 3,459,955 | 8/1969 | Hurlbert | 340/856 X |
| 3,490,286 | 1/1970 | Schwartz | 73/362 |
| 3,587,076 | 6/1971 | Grover | 340/182 |
| 3,732,728 | 5/1973 | Fitzpatrick | 73/151 |
| 3,932,836 | 1/1976 | Harrell et al. | 340/856 |
| 3,968,691 | 7/1976 | Balkanli | 73/345 |
| 4,023,136 | 5/1977 | Lamensdorf et al. | 340/18 |
| 4,157,535 | 6/1979 | Balkanli | 340/18 |
| 4,157,659 | 6/1979 | Murdock | 73/151 |
| 4,195,349 | 3/1980 | Balkanli | 364/571 |
| 4,230,187 | 10/1980 | Seto et al. | 166/362 |
| 4,581,613 | 4/1986 | Ward et al. | 340/856 |
| 4,597,067 | 6/1986 | Bockhorst et al. | 340/861 |
| 4,620,189 | 10/1986 | Farque | 340/856 |
| 4,631,536 | 12/1986 | Ward et al. | 340/857 |
| 4,788,545 | 11/1988 | Farque | 340/856 |

OTHER PUBLICATIONS

TRW Reda Pumps-Brochure, Pressure & Temperature Sensing, p. 1.

Centrilift Submersible Pumps-Byron Jackson and Borg-Warner PHD System-Brochure, Bulletin #BJCP 64-113.

Lyner Sentry Systems-Brochure, 1980.

*Primary Examiner*—Brian S. Steinberger

*Attorney, Agent, or Firm*—Head & Johnson

[57] ABSTRACT

An apparatus for measuring one or more parameters of the subsurface environment, and telemetering one or more parameters of the subsurface environment to the surface. Apparatus at the surface includes a source of intermediate frequency and voltage, electrical energy for transmission down one or more conductors of a power cable or separate instrument wire to a downhole instrument package. This intermediate frequency voltage is converted to a power supply voltage for generating a high frequency FM signal, in accordance with the magnitude of one or more parameters of the environment. This frequency modulated signal is sent to the surface over the conductors of the power cable and ground. At the surface the signal is demodulated to produce a signal indicative of the transmitted parameter.

4 Claims, 2 Drawing Sheets

PARAMETER TELEMETERING FROM THE BOTTOM OF A DEEP BOREHOLE

RELATED APPLICATIONS

This is a continuation of co-pending application Ser. No. 06/866,896 filed on 05/27/86, now U.S. Pat. No. 4,788,545, which is a continuation-in-part of Ser. No. 06/523,455 filed on 08/15/83, now U.S. Pat. No. 4,620,189.

BACKGROUND OF THE INVENTION

1. Field of the Invention

This invention lies in the field of telemetering electrical signals from the bottom of a deep borehole to the surface. More particularly, it concerns the in situ measurement of temperature, pressure and/or other parameters, frequency modulating a high frequency carrier in accordance with the values of these parameters. This high frequency F.M. signal is generated and coupled to the bottom end of the power conductors that supply power to the drive motor. A coupling means picks off this high frequency F.M. signal at the surface and demodulates it to provide the original parameter values, which can then be displayed.

2. Description of the Prior Art

In the prior art there are a number of examples of instruments for making such parameter measurements at the bottom of a deep borehole, and transmitting them by means of cable to the surface where they can be utilized. Some of the transducers or sensors are of a well known design which produce a DC voltage or current which varies with the parameter. While these are simple instruments, they do offer considerable difficulty in their transmission because of the variable conditions along the conductor to the surface including variation of resistance of those conductors and insulation leakage.

Furthermore, in the particular conditions under which this instrumentation is to operate, there will be a submerged pump and drive motor, the power for which is carried down along side of the tubing that supports the pump and motor by means of a polyphase cable. The presence of the power conductors for the motor obviate the need for a separate conductor to carry the parameter signals. However, on the basis of the ohmmeter-type sensor construction, they still require careful processing of the data in order to avoid the variation in surface amplitude of signal due to varying losses along the cable.

Coupling a small direct current signal from the sensors to the motor power conductors in the power cable has heretofore required considerable coupling apparatus which is bulky and expensive.

SUMMARY OF THE INVENTION

It is a primary object of this invention to provide a convenient, safe and rapid telemetering system for electrical signals from one or more parameter sensors positioned in a deep borehole.

It is a further object of this invention to provide a means for telemetering signals to the surface by means of the power conductors that carry the high voltage, three phase, alternating current to drive the motors located within a borehole.

These and other objects are realized and the limitations of the prior art overcome in this invention by providing a first (surface) instrument package at the surface, and a second (downhole) instrument package downhole contiguous to a fluid pump and drive motor. Each of these packages receives an alternating current signal from the other package and vice versa.

At the surface instrument package an electrical AC power source provides a low voltage intermediate frequency signal which is coupled to any one or all of the three power conductors. At the bottom hole instrument package, this signal is decoupled from the cable and is used to power the electronics in the bottom hole package.

One or more sensors are provided for measuring environmental parameters, such as temperature and pressure in the vicinity of the pump and motor. These two parameters, and others, are very important to the diagnosis of troubles when they occur in the downhole equipment, and serve to prevent mechanical and electrical difficulties, and to provide down hole well data.

The outputs of the parameter sensors produce signals which are used to modulate a high frequency carrier signal, which is coupled to the cable. At the surface the high frequency F.M. signal is coupled to a frequency modulation detector or receiver. This detector demodulates the carrier signal and puts out a digital signal which is a function of the downhole parameter being measured. This digital output signal can be displayed or recorded as desired.

There is no direct current (DC) transmission between the surface instrument package and the downhole instrument package. On the cable conductors there is an alternating current electrical power supply used to power the drive motor. There is a downgoing electrical signal of intermediate frequency to provide energy for a power supply, which can be DC in the downhole package. There is also a frequency modulated signal which telemeters the parameter signal up the cable from the downhole package to the surface instrument package.

The coupling means by which these packages are connected to the power conductors utilizes capacitance to isolate the two instrument packages from the high voltage motor power circuit. There are tuned circuit filter means for separating the combination signals from the drive motor power supply currents.

BRIEF DESCRIPTION OF THE DRAWINGS

These and other objects and advantages of this invention and a better understanding of the principles and details of the invention will be evident from the following description, taken in conjunction with the appended drawings, in which.

DESCRIPTION OF THE PREFERRED EMBODIMENT

While an instrument telemetering system of the sort that is covered by this invention can handle one or more separate signals, this would be done by conventional means, such as for example, providing one or more frequency modulation systems at different parameter frequencies. On the other hand, conventional switching means might be provided to alternately switch one parameter signal on and then the other one and back again to the first one and so on. Consequently, while the invention includes a plurality of sensor signals, the description is directed to apparatus for transmitting one parameter signal. The other apparatus that would be required for two or more signals would be a multiplex system, of which there are many described in the prior art, or a remote switching system wherein, for example, turning off and on, at the surface, the signal which transmits power to the sub-surface power supply, could be used to enable the switching from one parameter to another so that at the choice of the surface operator, he could have either of the two or more parameters being transmitted, that he should desire.

Figure 1:
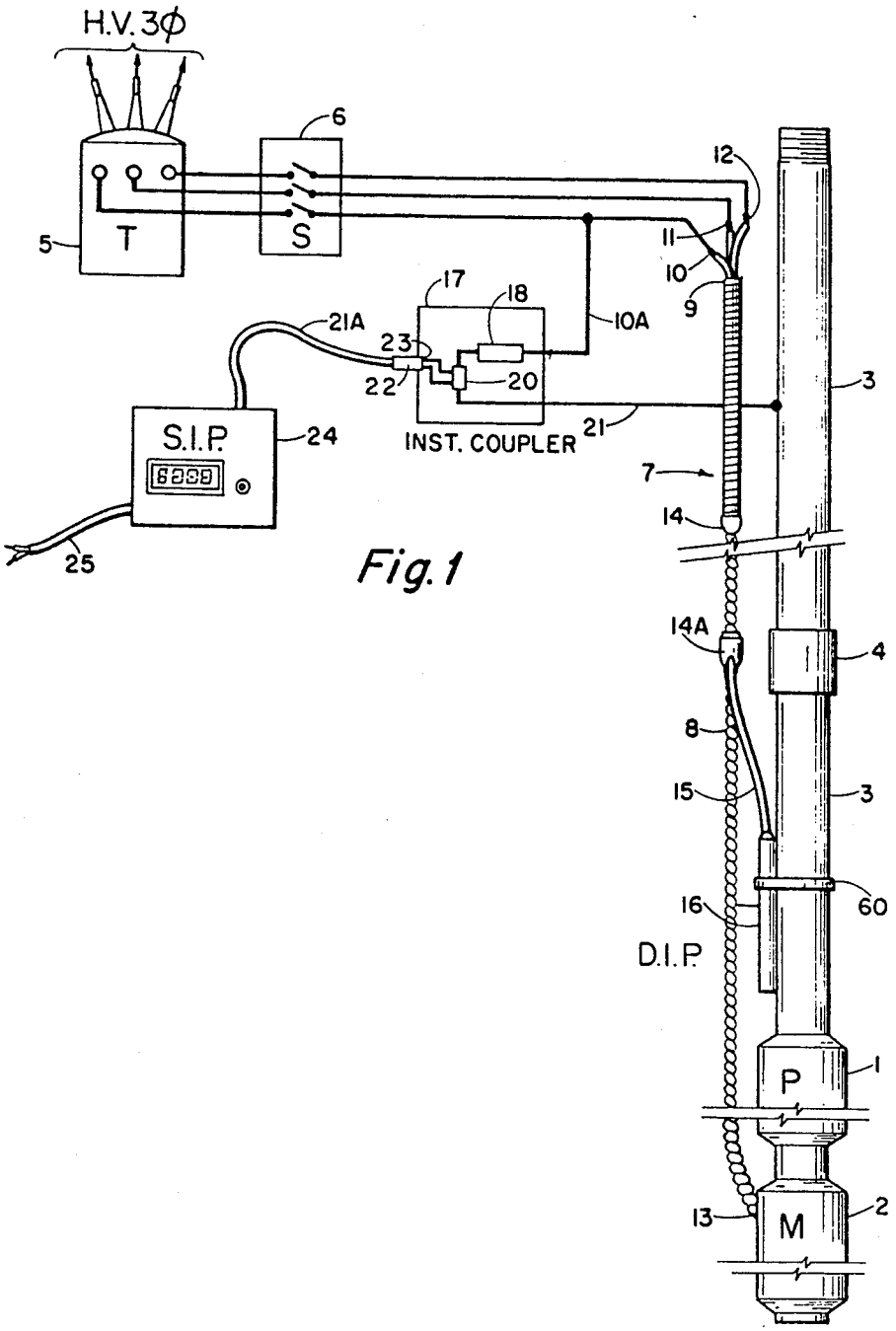
FIG. 1 illustrates the overall instrument and equipment units which are required not only for the data telemetering, but for the pumping of the liquids from the bottom of the borehole.

Referring now to FIG. 1, there is shown the overall system and equipment units which are required not only for the data telemetering, but for the pumping of the liquids from the bottom of the borehole.

The field apparatus includes as shown in FIG. 1, a pipe or tubing 3 with collars 4 which extends from the surface where it is attached to commercial apparatus for receiving and storing the liquid which is pumped from the bottom of the hole, down to a selected depth. The tubing is attached to a conventional pump P indicated by numeral 1 and a drive motor M numeral 2, which drives the pump. Power is supplied from the surface transformer 5 and surface switching means 6. Connected to the switch is a three conductor cable 7 which has three conductors 10, 11 and 12 able to withstand the currents and high voltages impressed on it at the surface. This cable 7 is usually a round cylindrical cable and is usually armored with steel wrapping 9 in a conventional manner to protect it during the entry of the pump, motor, and tubing down the borehole.

In the vicinity of the sub-surface equipment, that is, the pump and motor, the cable is joined by a splice 14 to another cable 8 which instead of being round is flat or oval, in which the three conductors are placed in a side by side arrangement, instead of a grouping of three. The purpose of this reduction change in shape of the cable is to minimize the overall diameter of the sub-surface equipment. This is important since the motor and pump are of a diameter somewhat larger than the tubing, and there is always the desired to utilize as small a casing as possible in order to minimize the cost of drilling.

The drawing is not to scale, and of course the pump and motor are of considerable length and substantially larger diameter than the tubing. The downhole instrument package (DIP) 16 is attached to a cable 15 which may be spliced into a junction 14A in cable 8. The instrument is internally grounded to the casing 16, which can be attached to the sub-surface equipment in the vicinity of the pump and/or motor using clamps 60. Of course, the DIP can be hung below the motor or in between the motor and pump, etc. as desired. Also the sensors could include other parameters of interest to the petroleum industry.

The DIP can also be connected by a cable, separate or included within the power cable 7 and 8, which extends to the surface.

At the surface there is a surface instrument package (SIP) 24 which is provided with power over leads 25 in a conventional manner. All of the surface electronics that are required can be in this package 24.

The output cable 21A from the SIP is connected to an instrument coupler device 17.

This telemetering system utilizes one or more of the three conductors. FIG. 1 shows conductor 10 connected to the instrument coupler by line 10A. The other lead 21 from the instrument coupler goes to ground, which can be tubing 3, which is available at the surface and extends down to the point of positioning of the DIP. Because there is a very high potential on the three conductors, the instrument coupler is required to isolate the surface instrument package (SIP) from the high voltage. This is done by means of a high voltage capacitance 18 (one capacitor for each conductor used) and a voltage limiting device or filler component 20. This can be any of the conventional type of solid state devices for maintaining or shielding an apparatus from high voltages.

Figure 2:
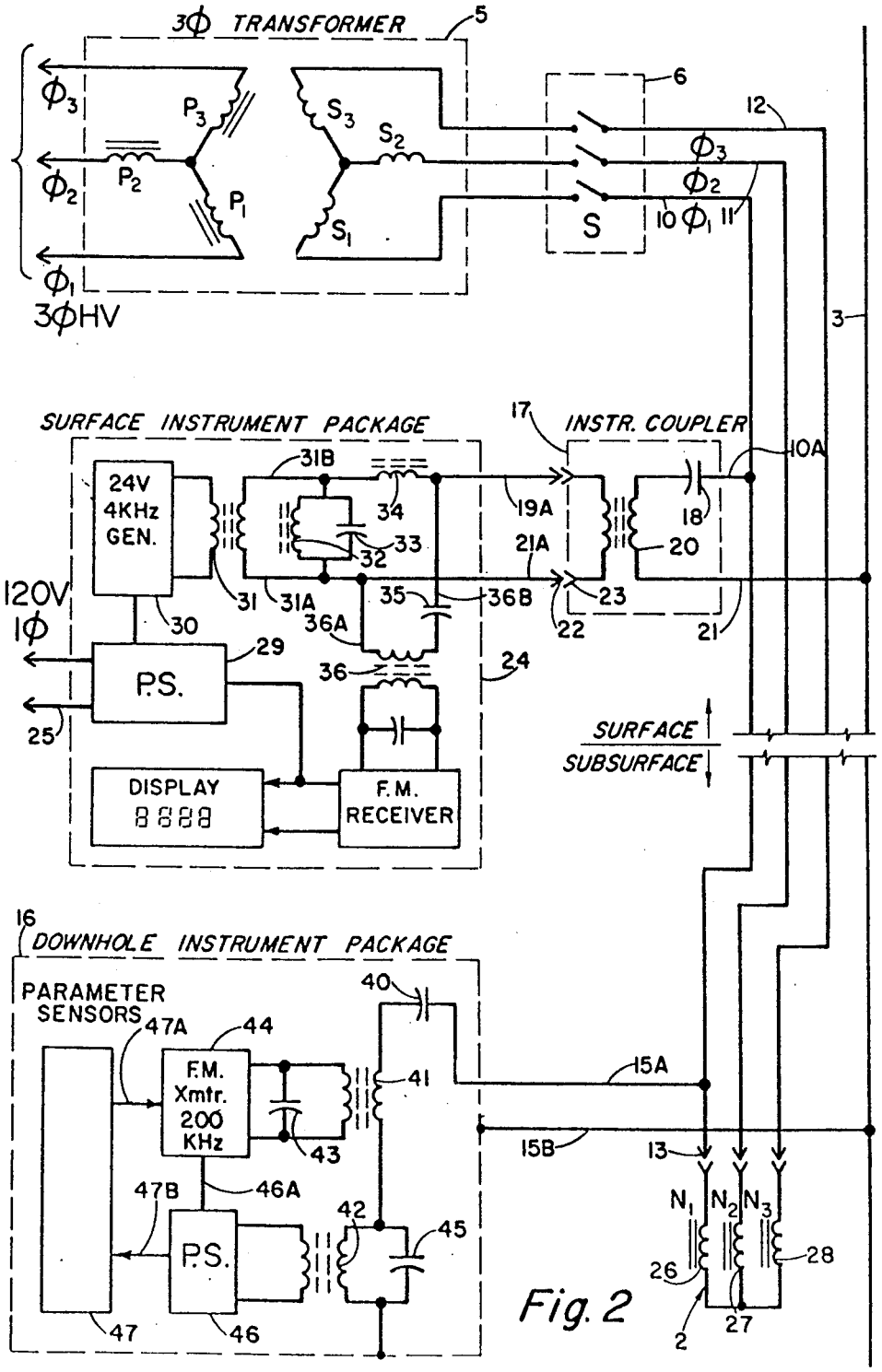
FIG. 2 is a schematic diagram illustrating in considerable detail the electronic circuitry involved in the surface and sub-surface or downhole instrument packages.

As explained, FIG. 1 does not show detail of the surface or sub-surface equipment and this is shown separately by FIG. 2. Referring to FIG. 2, the equipment for supplying power to the downhole motor is indicated by the three phase transformer 5 shown in dashed outline, with the three entering power leads, 1, 2, 3. The transformer primary and secondary wings P1, P2, P3, S1, S2, S3, and three phase switch S6 going to the three conductors 10, 11 and 12 representing 1, 2, 3. The line 3 represents the ground conductor which in this case could be the tubing, as previously explained.

Briefly, the system comprises in the surface instrument package (SIP) a source of intermediate frequency, such as 4 KHz, a power supply unit 29 fed by a conventional 120 volt single phase line 25. The output of the intermediate frequency oscillator 30 goes through the transformer 31 for further isolation. The secondary of transformer 31 has filter connected across its terminals in which include a shunt capacitor 33 and inductor 32. There is also a series inductor 34 for isolating the intermediate frequency oscillator 30 from another signal which will be a high frequency F.M. signal, which carrier may be greater than 10.5 KHz and typically of the order of 200 KHz. The connection then goes via leads 19A and 21A to the instrument coupler 17 which, as shown, utilizes transformer 20 and a capacitance 18 for each conductor used. The lead 10A from the instrument coupler goes to conductor 10 and lead 21 goes to the ground conductor 3.

Thus far has been described apparatus for generating an intermediate frequency of 4 KHz and filtering apparatus and isolating instrument coupler apparatus and connection at the surface to conductor 10 of the cable and ground which in this case is tubing 3.

The intermediate frequency signal which preferably is a relatively low voltage of substantially constant frequency, is transmitted down the cable and ground to the downhole instrument package (DIP). The conductor 15A of the instrument cable 15 is connected to conductor 10 and the second conductor 15B is internally connected to the DIP case 16 and to ground 3. Any additional connections from the DIP transformer 41 to the other two conductors 11 and 12 shall also include a series capacitance similar to that shown at 40. The three power conductors continue through a typical plug system 13 and a corresponding socket in the case of the motor, and are connected to the windings 26, 27 and 28 of the motor 2.

The high voltage present on conductor 15A is isolated from the DIP by the capacitor 40.

The purpose of the downhole instrument package (DIP) is primarily to take the outputs of one or more parameter measuring sensors, such as temperature and pressure sensors, which are housed in the box 47, convert them to a high frequency F.M. signal which can be transmitted to the SIP which contains corresponding filtering/decoding equipment, as will be explained later.

The principle problem of transmitting low voltage D.C. signals over long cables is that because of the varying resistance of the cable conductors and insulation leakage, it is very difficult to transmit a true indication of the values of the parameters. In this invention, the signal has been converted to a high frequency signal which can be a frequency modulated (F.M.) signal. That is, the low frequency data signals from the sensors representing temperature and pressure will be used to modulate this high frequency carrier signal, which is above 10.5 KHz and typically in the order of 200 KHz or higher, in accordance with the value of the parameters.

Consequently, at the surface the variation in the high frequency F.M. signal will be decoded and the varying low frequency data signals will be indicative of the parameters being transmitted and displayed.

In FIG. 2, the intermediate frequency signal enters the downhole instrument 16 by way of conductors 15A and 15B.

The intermediate frequency signal passes through the capacitor 40, which is used to prevent the high voltage AC from entering the DIP electronics, and through the primary of transformer 41. The intermediate frequency signal then passes through the tuned filter, using transformer 42 and capacitor 45, to the power supply circuit 46. In the power supply circuit the intermediate frequency signal is converted to DC voltages that can power parameter sensor oscillators 47 and the F.M. transmitter 44 through conductors 47B and 47A respectively. The low frequency data signals from 47 modulate the high frequency carrier generated by the F.M. transmitter 44. The high frequency F.M. signal then passes through capacitor 40 to the motor power conductor 10 by conductor 15A.

The high frequency F.M. signal passes through the motor power conductor 10 and ground 3 to the instrument coupler 17. The high frequency F.M. signal passes through capacitance 18 and transformer 20 where it is applied to conductors 19A and 21A. The high frequency F.M. signal then passes through the filter comprised of capacitor 35 and transformer 36 by way of conductors 36A and 36B. This filter permits only the high frequency F.M. signal to enter the F.M. receiver. The F.M. receiver separates the low frequency data signals from the high frequency carrier. The data signals are then converted to their proper units and displayed.

While the invention has described temperature and pressure sensors at the bottom of the borehole, no illustrations of such have been given. It is to be understood that any transducer or other sensor sensing other well parameters can be used.

The capacitances 40 in the DIP and 18 in the SIP are for the purpose of allowing use of the system described with or without motor voltage being present.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. In a submersible pump installation having a power cable for delivering AC power from a power source at the surface through a multiple conductor cable to an AC motor located in a well, a separate ground conductor means formed as a part of the pump installation extending from the surface to a selected depth in the well, measuring means for monitoring at the surface at least one physical parameter in the environment of the motor, comprising in combination:

a downhole assembly located in the well in the vicinity of the motor and having a transmitter means for generating a carrier signal independent of said AC power and for superimposing the carrier signal onto a circuit which includes one conductor in said multiple conductor cable and the ground;

sensing means in the downhole assembly for providing an electrical signal corresponding to the magnitude of said at least one physical parameter;

modulating means in the downhole assembly for modulating the carrier signal with the electrical response, and providing a modulated signal to the circuit defined by said one conductor and the ground conductor means that corresponds to the physical parameter; and conversion means in a surface unit for converting the modulated signal into a readout signal proportional to the physical parameter.

2. The installation of claim 1 wherein said ground conductor is tubing connected to said pump.

3. The installation of claim 1 wherein said measuring means is operative while said motor is off.

4. The installation of claim 1 wherein said measuring means is operative while said motor is on.

* * * * *